US008173241B2

(12) United States Patent
Halahmi et al.

(10) Patent No.: US 8,173,241 B2
(45) Date of Patent: May 8, 2012

(54) SANDWICH SYSTEM

(75) Inventors: Izhar Halahmi, Hod Hasharon (IL); Oded Erez, Tel Aviv (IL); Adi Erez, Tel Aviv (IL)

(73) Assignee: PRS Mediterranean Ltd. (IL)

( * ) Notice: Subject to any disclaimer, the term of this patent is extended or adjusted under 35 U.S.C. 154(b) by 798 days.

(21) Appl. No.: 12/238,927

(22) Filed: Sep. 26, 2008

(65) Prior Publication Data

US 2009/0142542 A1 Jun. 4, 2009

Related U.S. Application Data

(60) Provisional application No. 60/975,576, filed on Sep. 27, 2007.

(51) Int. Cl.

| | |
|---|---|
| ***B32B 7/00*** | (2006.01) |
| ***B32B 3/12*** | (2006.01) |
| ***E02D 3/12*** | (2006.01) |
| ***E02D 29/00*** | (2006.01) |
| ***E02D 3/00*** | (2006.01) |

(52) U.S. Cl. ..... 428/119; 428/116; 405/262; 405/284; 405/302.4

(58) Field of Classification Search ..... None
See application file for complete search history.

(56) References Cited

U.S. PATENT DOCUMENTS

| | | | | |
|---|---|---|---|---|
| 4,374,798 | A | 2/1983 | Mercer | |
| 4,530,622 | A | 7/1985 | Mercer | |
| 4,940,364 | A * | 7/1990 | Dlugosz | 405/229 |
| 5,320,455 | A * | 6/1994 | Mattox | 405/284 |
| 6,020,275 | A * | 2/2000 | Stevenson et al. | 442/60 |
| 2006/0147276 | A1 * | 7/2006 | Lin et al. | 405/302.4 |
| 2007/0131145 | A1 * | 6/2007 | Biscan et al. | 106/600 |
| 2007/0144407 | A1 * | 6/2007 | Biscan et al. | 106/819 |
| 2007/0183852 | A1 | 8/2007 | Beretta | |

FOREIGN PATENT DOCUMENTS

WO WO 2007/119121 A1 10/2007

OTHER PUBLICATIONS

International Search Report mailed Dec. 12, 2008.
Geocell Systems, Inc., "Road Shoulder Construction: Soil Stabilization Using Sand Confinement Grids", Road Shoulder Construction # 10; Nov. 13, 2002.
Presto Products Company, "Porous Pavement Systems", 2000 Presto Products Company.

* cited by examiner

*Primary Examiner* — Gordon R Baldwin
(74) *Attorney, Agent, or Firm* — Richard M. Klein; Fay Sharpe LLP

(57) ABSTRACT

A composite system comprises a base layer, a capping layer, and at least one core geocell layer. The base layer and capping layer are staked below and above the core geocell layer, which is infilled with a low quality material. In specific embodiments, the base layer and capping layer are each geocells infilled with a high quality material. This composite system meets engineering specifications economically.

16 Claims, 9 Drawing Sheets

SANDWICH SYSTEM

RELATED APPLICATIONS

The present application claims priority to U.S. Provisional Patent Application Ser. No. 60/975,576, filed Sep. 27, 2007, the contents of which are fully incorporated herein by reference.

BACKGROUND

The present disclosure relates to a platform for carrying loads built from cellular confinement systems, also known as geocells. In particular, such platforms can carry high static, transitory, or vibratory loads. The present disclosure also relates to the components of such platforms and methods for making and using such platforms.

A cellular confinement system (CCS) is an array of containment cells resembling a "honeycomb" structure that is filled with infill, which can be cohesionless soil, sand, gravel, or any other type of aggregate. Also known as geocells, CCSs are used in applications to prevent erosion or provide lateral support, such as gravity retaining walls for soil, alternatives for sandbag walls, and for roadway and railway foundations. CCSs differ from geogrids or geotextiles in that geogrids/geotextiles are generally flat (i.e., two-dimensional) and used as planar reinforcement, whereas CCSs are three-dimensional structures with internal force vectors acting within each cell against all the walls.

The amount of load which a particular location can bear depends on the strength of the soil at that location. Soil is any material found in the earth at a locality, which may comprise of naturally derived solids including organic matter, liquids (primarily water), fine to coarse-grained rocks and minerals, and gases (air). The liquids and gases occupy the voids between the solid particles. The packing of soil is known as densification and is achieved during construction by compaction. Compaction is the process in which high load is temporarily applied to the soil by mechanical means such as a roller. When soil is compacted, the solid particles are forced closer together, reducing the volume in the voids that is occupied by air.

Dense soil is rather strong under compression, but has little to no strength under tension. When granular soil is compacted to a dense state, as is required in proper construction, it will reach its peak shear strength under compressive stresses at rather low compressive strain—usually at 1 to 3% strain. However, at larger strains, it will quickly reach lower shear strength than its peak as it undergoes through a strain-softening phenomenon. As a result, even dense soils may bear load poorly.

Geocells have been used in roadway and railway foundations. For example, the traditional method of creating a base for such foundations on poor load-bearing soils involves over-excavating, then filling with imported material that bears the load well. However, this method requires that the poor load-bearing soil be disposed of. One supplier of geocells, Geocell Systems Inc., notes that using an 8-inch thick geocell layer with sand infill can provide load-bearing strength comparable to a thicker rock-filled base layer, saving on costs. Presto, another provider of geocells, also describes their use as load support systems. However, these uses both require the export of undesired soil as well. These two examples are also based on polyethylene (PE) geocells, which are relatively weak and soft and tend to creep during usage. Consequently, the contribution of such geocells to soil confinement and/or reinforcement under sustained load is limited.

It would be desirable to provide improved geocell systems that are economical, stiff, strong, and support high sustained loads while reducing or preventing the need to export native soil elsewhere.

BRIEF DESCRIPTION

Disclosed in various embodiments, is a composite system used as a foundation for increasing the load-bearing capacity of a given location.

In embodiments, the composite system comprises:

- at least one core geocell layer infilled with an infill material; and
- at least one outer layer, the outer layer having greater tensile stiffness compared to the core geocell layer.

Exemplary outer layer(s) include (1) a geocell infilled with high quality material; (2) a fiber reinforced polymer sheet; (3) a fiber reinforced concrete slab; (4) a metal sheet; (5) a fiber reinforced polymeric or ceramic foam; (6) high quality material reinforced by a geogrid/geotextile; and (7) a geocell filled with concrete or a concrete mixture with particulate material.

In embodiments, a composite system comprises:

- at least one core geocell layer infilled with a low quality material;
- a base layer; and
- a capping layer;
- the at least one core geocell layer being stacked between the base layer and the capping layer; wherein the base layer and capping layer are independently selected from the group consisting of a geocell infilled with high quality material, a fiber reinforced polymer sheet, a fiber reinforced concrete slab, a metal sheet, a fiber reinforced polymeric or ceramic foam, a high quality material reinforced by a geogrid/geotextile, and a geocell filled with concrete or a concrete mixture with particulate material.

In other embodiments, a composite geocell system comprises:

- a base geocell layer infilled with a first high quality material;
- a capping geocell layer infilled with a second high quality material; and
- at least one core geocell layer infilled with a low quality material;
- wherein the at least one core geocell layer is stacked between the base geocell layer and the capping geocell layer.

The first high quality material and second high quality material may be independently selected from the group consisting of gravel, crushed stone, sand, crushed concrete, and mixtures thereof.

The low quality material may be selected from the group consisting of silt, low plasticity clay, fly ash, and mixtures thereof. In specific embodiments, the low quality material is further chemically modified by the addition of cement, liquid inorganic binder (such as silicates), or organic binder (such as an acrylic or epoxy emulsion). The chemical modification lowers the plasticity of the material, increases its shear or compressive strength, or lowers its expansion when it adsorbs water.

The composite system may further comprise a first geotextile layer directly above the at least one core geocell layer and a second geotextile layer directly below the at least one core geocell layer. These geotextile layers may aid in keeping the low quality material contained within the core geocell layer.

The composite system may further comprise a water-impermeable membrane located below the base layer. This membrane may reduce the amount of ground water which can enter the core geocell layer, thus reducing the swelling of the low quality infill material.

The height of the at least one core geocell layer may be greater than the height of both the base layer and the capping layer. In specific embodiments, the height of the at least one core geocell layer is at least five times greater than each of the height of the base layer and the height of the capping layer. In further embodiments, the height of the at least one core geocell layer may be from about five times to about 100 times greater than each of the height of the base layer and the height of the capping layer.

The geocell may comprise a material selected from the group consisting of engineering thermoplastics, such as polyamide or polyester and mixtures thereof, and alloys thereof. The alloys may further comprise polyethylene or polypropylene. The engineering thermoplastics may be reinforced with fibers, such as glass fibers, metal fibers, Kevlar™ fibers, polyamide fibers, and polyester fibers. In specific embodiments, the material from which the geocell is constructed may comprise a long glass fiber-reinforced polyester-HDPE alloy. In another specific embodiment, the material from which the geocell is constructed may comprise a polyester-polyethylene alloy.

In specific embodiments, the material from which the geocell is constructed may have a tensile elastic modulus of 700 MPa or greater at 1% deformation, when measured at 10% per minute strain rate. In other specific embodiments, the material from which the geocell is constructed may have a tensile yield stress at 10% per minute strain rate of 15 MPa or greater. In other specific embodiments, the material from which the geocell is constructed may have a creep deformation after 500 hours at 23° C., under 50% of yield stress, of 10% or less.

The composite system may further comprise at least one reinforcing geocell layer infilled with a third high quality material, the at least one reinforcing geocell layer stacked between the base geocell layer and the capping geocell layer. There may be a total of two core geocell layers, wherein the reinforcing geocell layer is located between the two core geocell layers.

These and other non-limiting embodiments are described in more detail below.

BRIEF DESCRIPTION OF THE DRAWINGS

The following is a brief description of the drawings, which are presented for the purpose of illustrating the exemplary embodiments disclosed herein and are not for the purpose of limiting the same.

DETAILED DESCRIPTION

The following detailed description is provided so as to enable a person of ordinary skill in the art to make and use the embodiments disclosed herein and sets forth the best modes contemplated of carrying out these embodiments. Various modifications, however, will remain apparent to those of ordinary skill in the art and should be considered as being within the scope of this disclosure.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Figure 1:
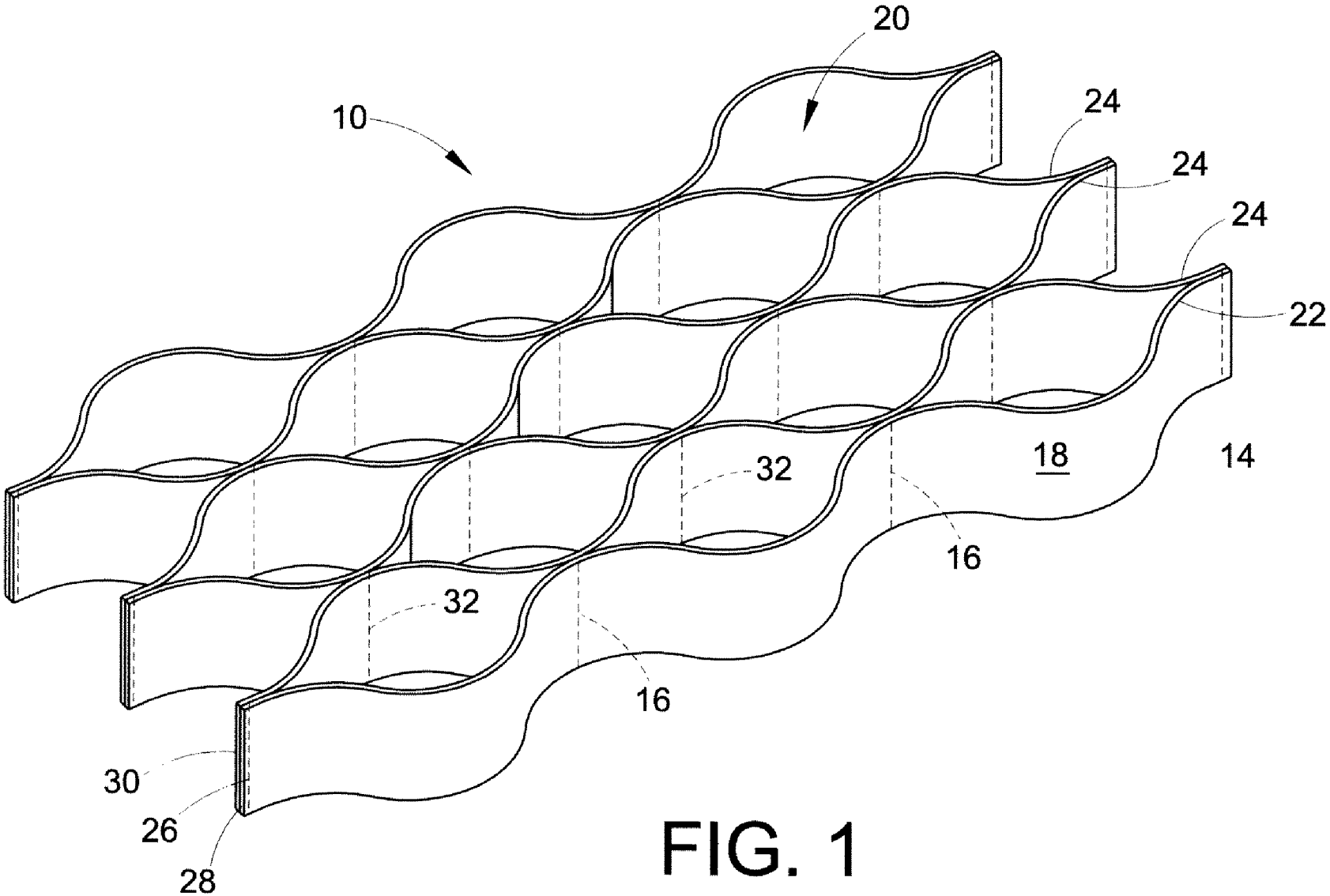
FIG. 1 is a perspective view of a single layer geocell.

FIG. 1 is a perspective view of a single layer CCS or geocell. The CCS 10 comprises a plurality of polymeric strips 14. Adjacent strips are bonded together by discrete physical joints 16. The bonding may be performing by gluing, bonding, sewing or welding, but is generally done by welding. The portion of each strip between two joints 16 forms a cell wall 18 of an individual cell 20. Each cell 20 has cell walls made from two different polymeric strips. Each cell in the CCS is generally of the same size. The strips 14 are bonded together to form a honeycomb pattern from the plurality of strips. For example, outside strip 22 and inside strip 24 are bonded together by physical joints 16 which are regularly spaced along the length of strips 22 and 24. A pair of inside strips 24 is bonded together by physical joints 32. Each joint 32 is between two joints 16. As a result, when the plurality of strips 14 is stretched in a direction perpendicular to the faces of the strips, the strips bend in a sinusoidal manner to form the CCS 10. At the edge of the CCS where the ends of two polymeric strips 22, 24 meet, an end weld 26 (also considered a joint) is made a short distance from the end 28 to form a short tail 30 which stabilizes the two polymeric strips 22, 24.

The composite system of the present disclosure comprises at least one core geocell layer infilled with an infill material; and at least one outer layer, the outer layer having greater tensile strength than the core geocell layer. Exemplary outer layer(s) include (1) a geocell infilled with high quality material; (2) a fiber reinforced polymer sheet; (3) a fiber reinforced concrete slab; (4) a metal sheet; (5) a fiber reinforced polymeric or ceramic foam; (6) high quality material reinforced by a geogrid/geotextile; and (7) a geocell filled with concrete or a concrete mixture with particulate material.

Figure 2:
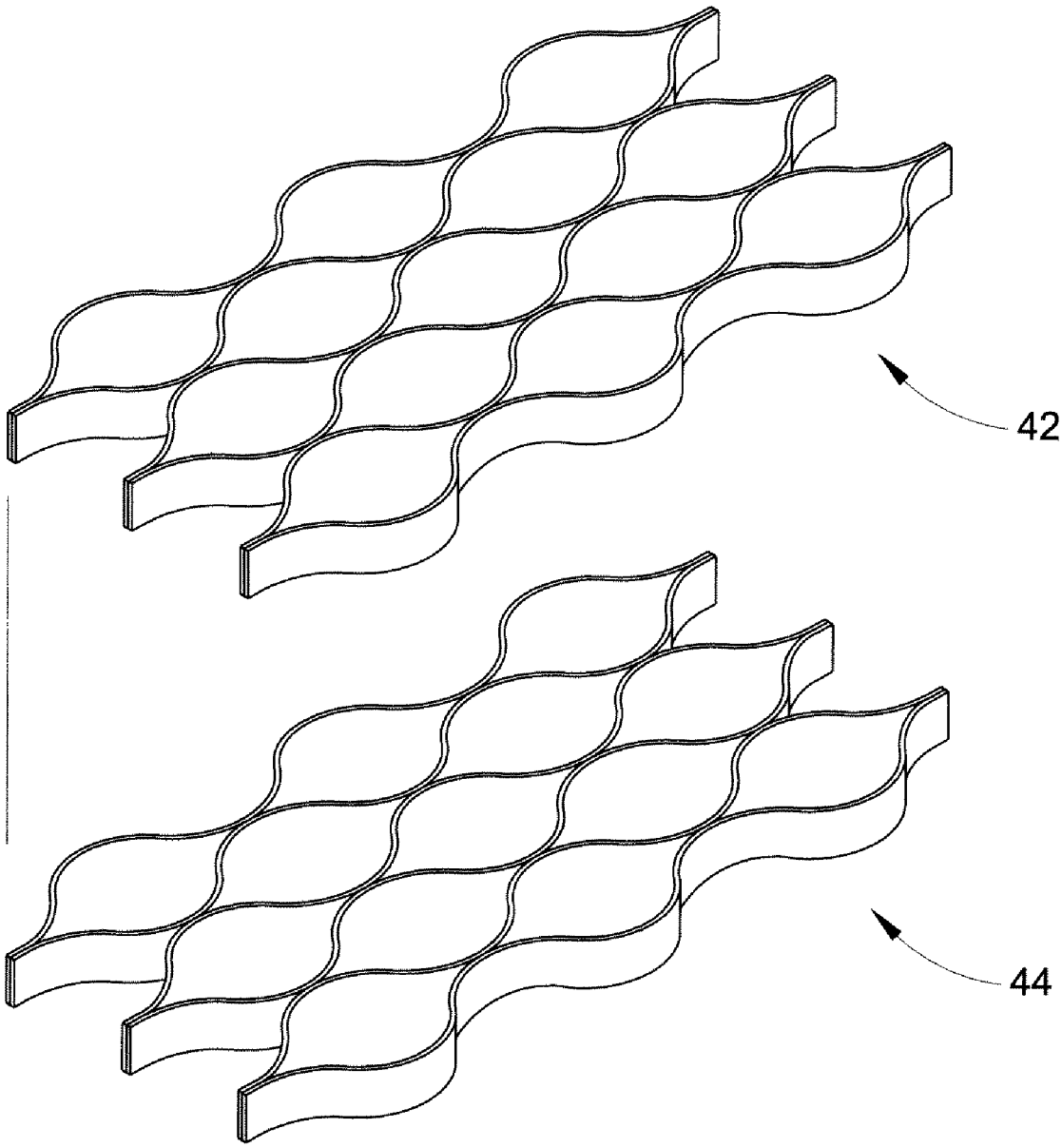
FIG. 2 is a perspective view of one embodiment of a composite system according to the present disclosure.

FIG. 2 is a perspective view of one embodiment of the composite system. Here, the composite system 40 has at least one core geocell layer 44 and an outer layer 41 which is a geocell infilled with high quality material. (The layers are separated for easier illustration.)

Figure 3:
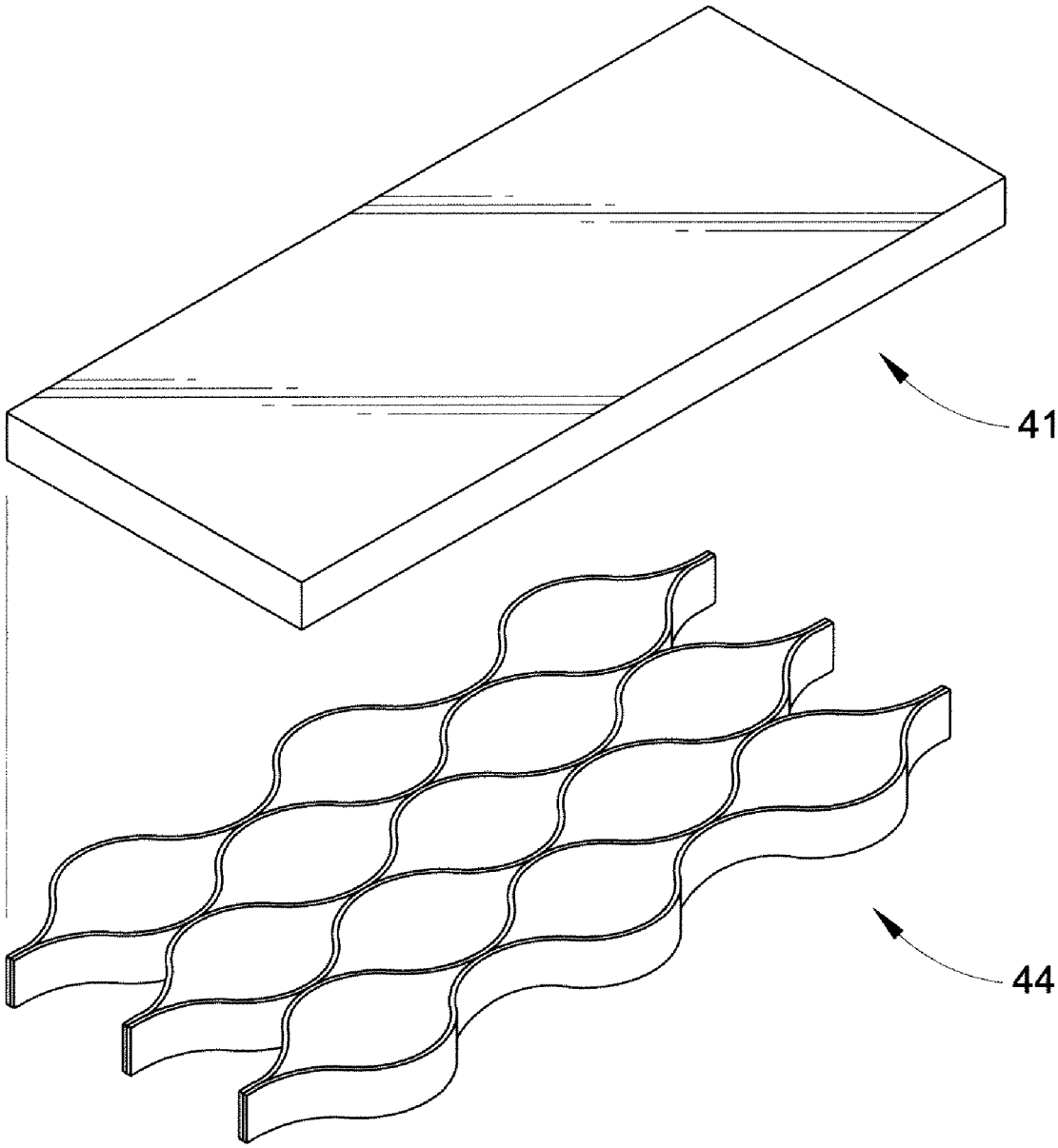
FIG. 3 is a perspective view of another embodiment of a composite system according to the present disclosure.

FIG. 3 is a perspective view of another embodiment of the composite system. Here, the composite system 40 has at least one core geocell layer 44 and an outer layer 41 which is a fiber reinforced concrete slab. (The layers are separated for easier illustration.)

Figure 4:
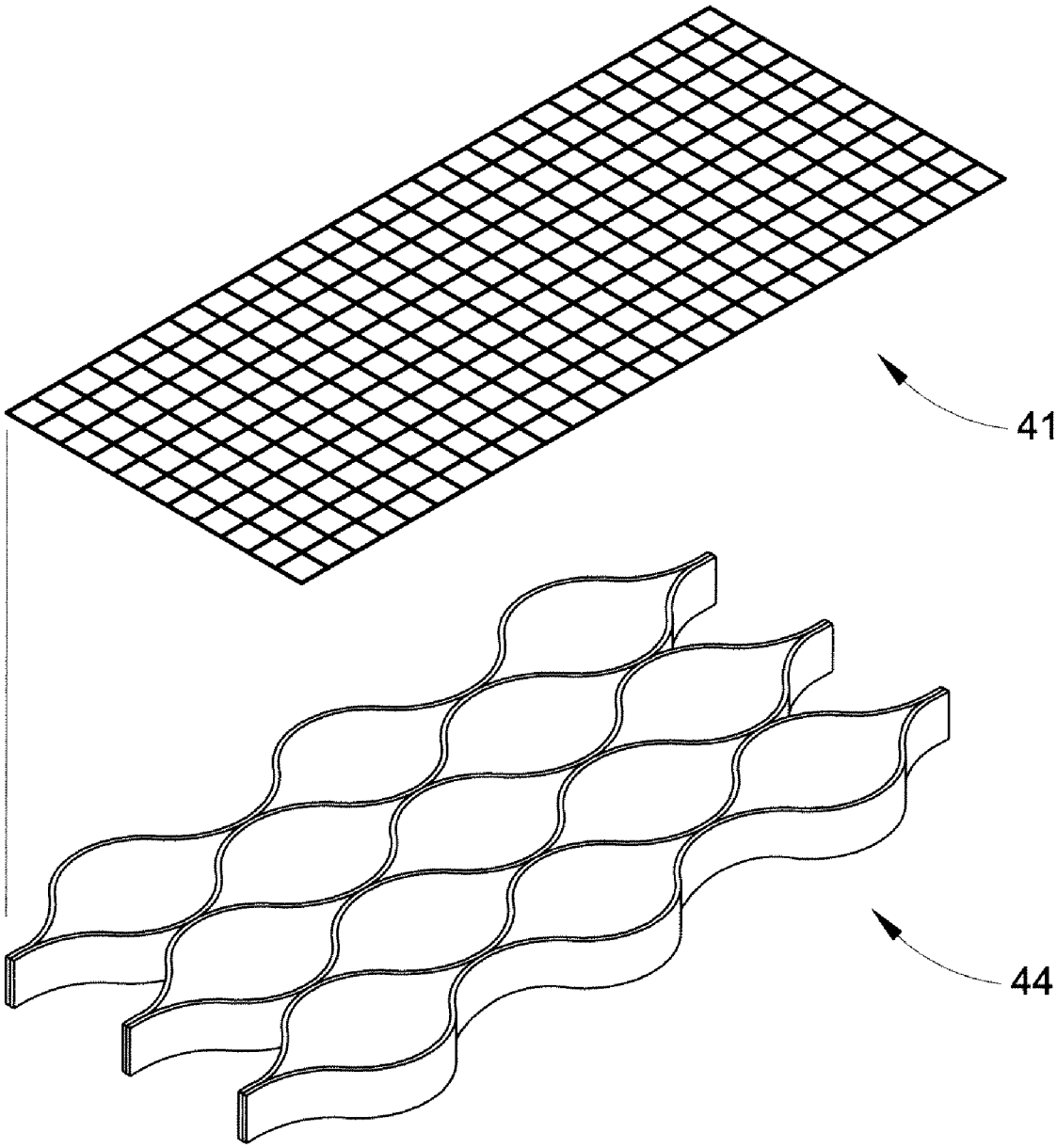
FIG. 4 is a perspective view of another embodiment of a composite system according to the present disclosure.

FIG. 4 is a perspective view of another embodiment of the composite system. Here, the composite system 40 has at least one core geocell layer 44 and an outer layer 41 which is a geogrid/geotextile. (The layers are separated for easier illustration.)

In some specific embodiments, the composite system has at least two outer layers, wherein the core geocell layer is located between two outer layers.

Figure 5:
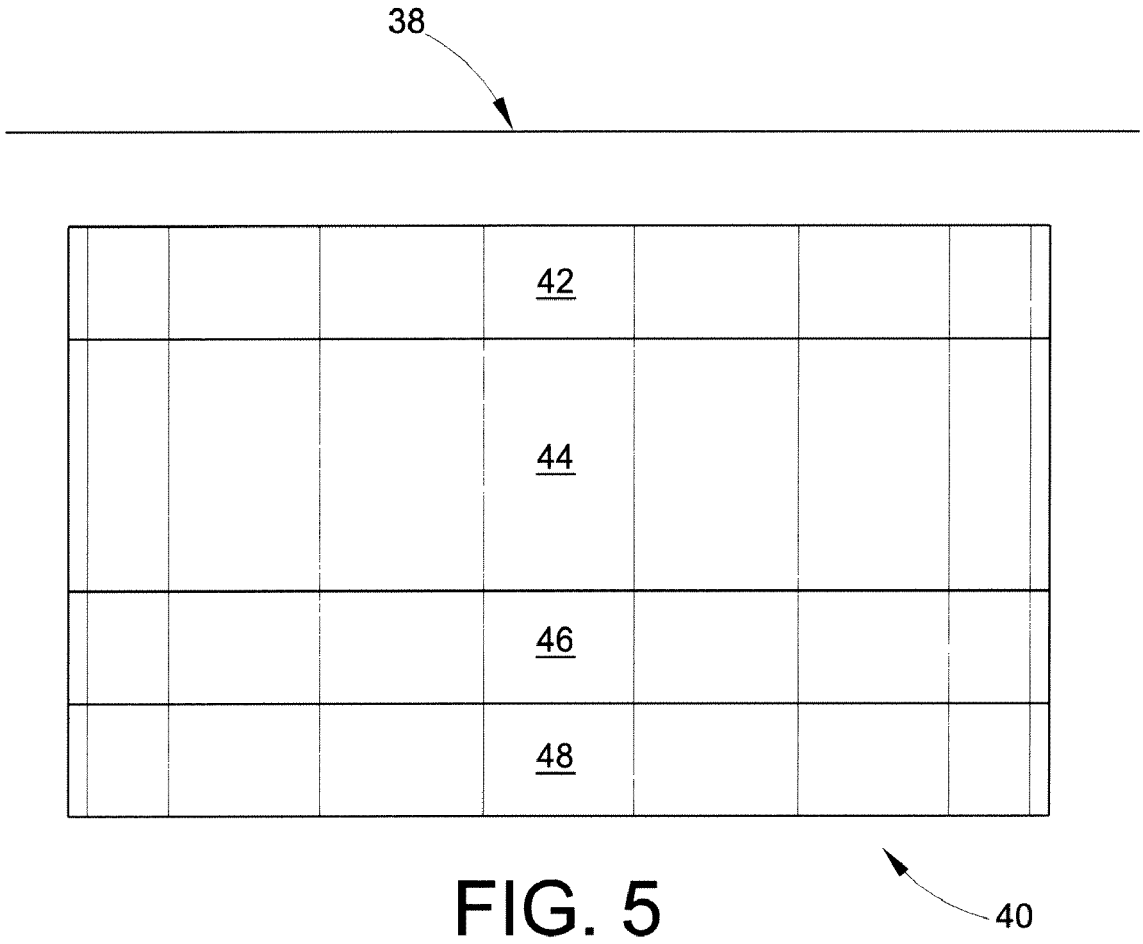
FIG. 5 is a side view of a composite system according to the present disclosure.

FIG. 5 is a side view of another composite system according to the present disclosure. The composite system 40 is located underneath the surface 38 of the earth and comprises at least three layers: a capping layer 42, a base layer 46, and at least one core geocell layer 44 stacked between the base layer and the capping layer. (The layers are separated for easier illustration.) The base layer and capping layer may be considered outer layers and are independently selected from the group consisting of a geocell infilled with a high quality material, a fiber reinforced concrete slab, and a fiber reinforced polymer sheet. The resulting composite system can carry high static, transitory, and/or vibratory loads. The load applied at the top of the composite system is spread over a large area, attenuating it as it reaches the foundation soil below. The system shown here further comprises a water-impermeable membrane 48.

The core layer increases the moment of inertia of the total composite system, making it stiffer. Shear stresses are not concentrated in the base and capping layers, but are nonlinear and vary throughout the height of the composite system. Each layer prevents shear failure of soil and contributes to the stiffness of the composite system. The low quality material in the core geocell layer, despite being inadequate as a load bearing material by itself, provides stiffness to the core and also prevents the geocell walls from collapsing. The outer layer(s), such as the base and capping layers, prevent failure modes which are typical to composite systems based on thermosetting resins, such as face yielding (where a layer thins out) and face wrinkling (where a layer buckles).

Figure 6:
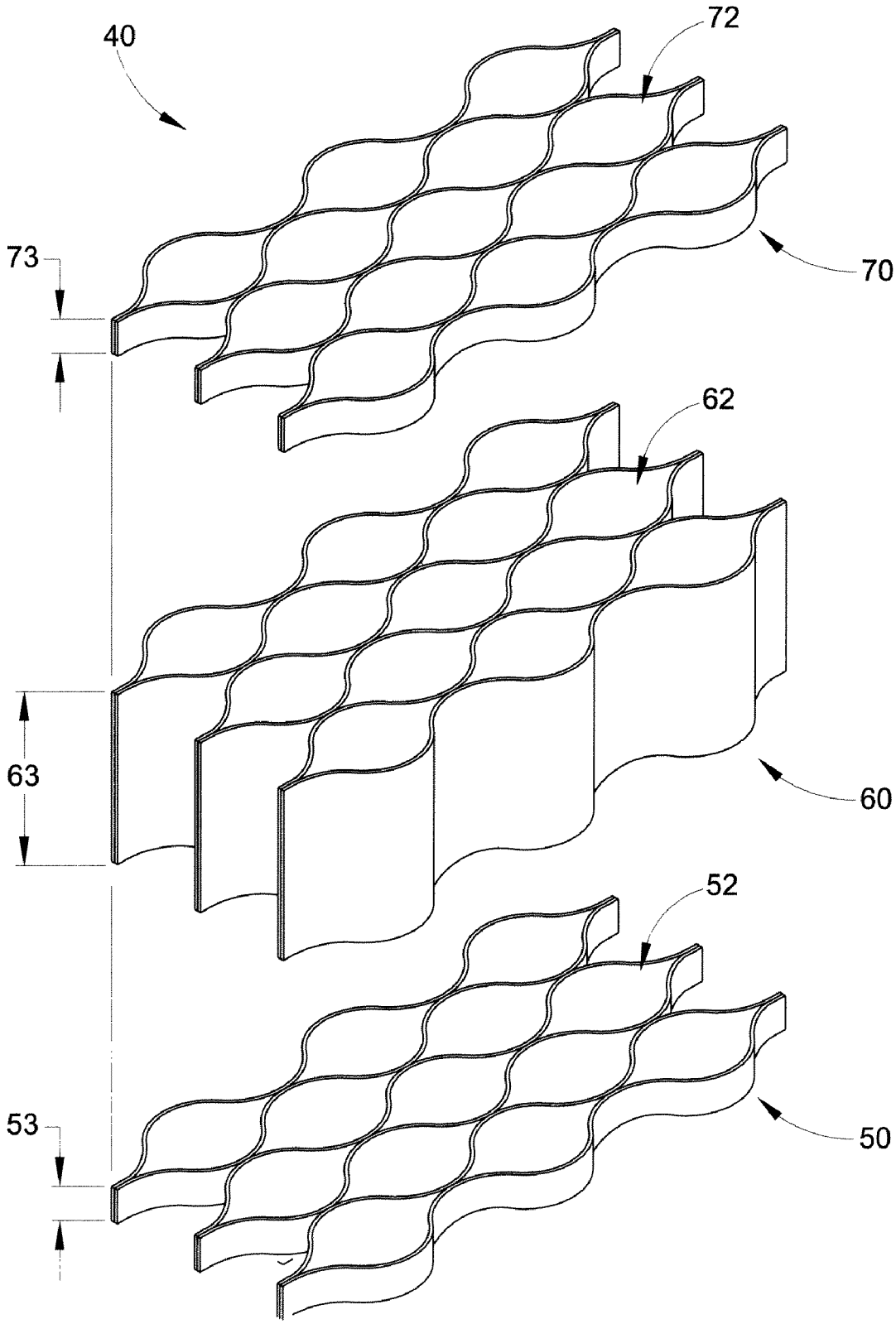
FIG. 6 is a perspective view of a composite geocell system according to the present disclosure.

In specific embodiments, the base layer is a geocell infilled with a first high quality material and the capping layer is a geocell infilled with a second high quality material FIG. 6 is a perspective view of a composite geocell system 40. The composite system 40 comprises a base geocell layer 50, at least one core geocell layer 60, and a capping geocell layer 70. The base geocell layer 50 contains a first high quality material 52 and the capping geocell layer 70 contains a second high quality material. The at least one core geocell layer 60 contains a low quality material 62. (The layers are separated for easier illustration.)

Generally, the core geocell layer (containing low quality infill) would not be sufficiently stiff to carry the applied load by itself. However, the high quality material in the base geocell layer and the capping geocell layer provides stiffness and strength to the composite geocell system. A synergy exists between the base layer, capping layer, and core geocell layer. The core geocell layer carries a portion of the shear stress, thus lowering the concentration of stress on the base and capping layers. The base and capping layers prevent the core geocell layer from deforming. As the height ratio between the core geocell layer and the outer layers increases, the moment of inertia also increases, reducing deformation in the outer layers as well. The height of the core geocell layer may also serve as a buffer against expansion of clay or other expanding soils below the pavement.

The base geocell layer and capping geocell layer increase the moment of inertia for the composite geocell system, increasing the bending moment resistance of the composite system.

A high quality material comprises particles, of which 90% by weight or more have an average diameter of 75 μm or greater. In addition, the high quality material has an internal angle of friction of 30° or greater and a permeability of $10^{-2}$ cm/sec or greater.

Exemplary high quality materials include sand, gravel, crushed concrete, any manmade or natural material meeting the above requirements, and mixtures thereof.

A low quality material comprises particles, of which 50% by weight or more have an average diameter of less than 75 μm. In addition, the low quality material has an internal angle of friction of 25° or less and a permeability of less than $10^{-4}$ cm/sec.

Exemplary low quality materials include silt, low plasticity clay, fly ash, and mixtures thereof. The low quality material may be mixed with higher quality materials to improve its properties, such as the amount of load it can bear, its compressibility, or its amount of expansion after adsorbing water. In specific embodiments, the low quality material is further chemically modified by the addition of cement, liquid inorganic binder (such as silicates), or organic binder (such as an acrylic or epoxy emulsion). In other specific embodiments, the low quality material is mixed with crushed stone to improve its load bearing capability.

If desired, the core geocell layer may be filled with a mixture of low quality material and high quality material. However, the core geocell layer is not filled with only high quality material.

Non-cohesive particles can be classified as silt, sand, and gravel, depending on the grain size of the particle. Silt particles have a maximum grain size of 0.075 mm, sand particles have a grain size from 0.075 mm to 4.75 mm, and gravel particles have a grain size greater than 4.75 mm. As discussed above, silt particles may be considered as low quality infill material, while sand and gravel particles are considered high quality infill materials. Low plasticity clay as defined by ASTM D4421 has poor workability, tends to undergo plastic deformation, and retains water The composite geocell system is well suited for situations where the native (local) soil is of low quality, such that it is unsuited for the particular engineering application. Rather than having to ship the native low quality soil off-site, it can be used in the core geocell layer.

Figure 7:
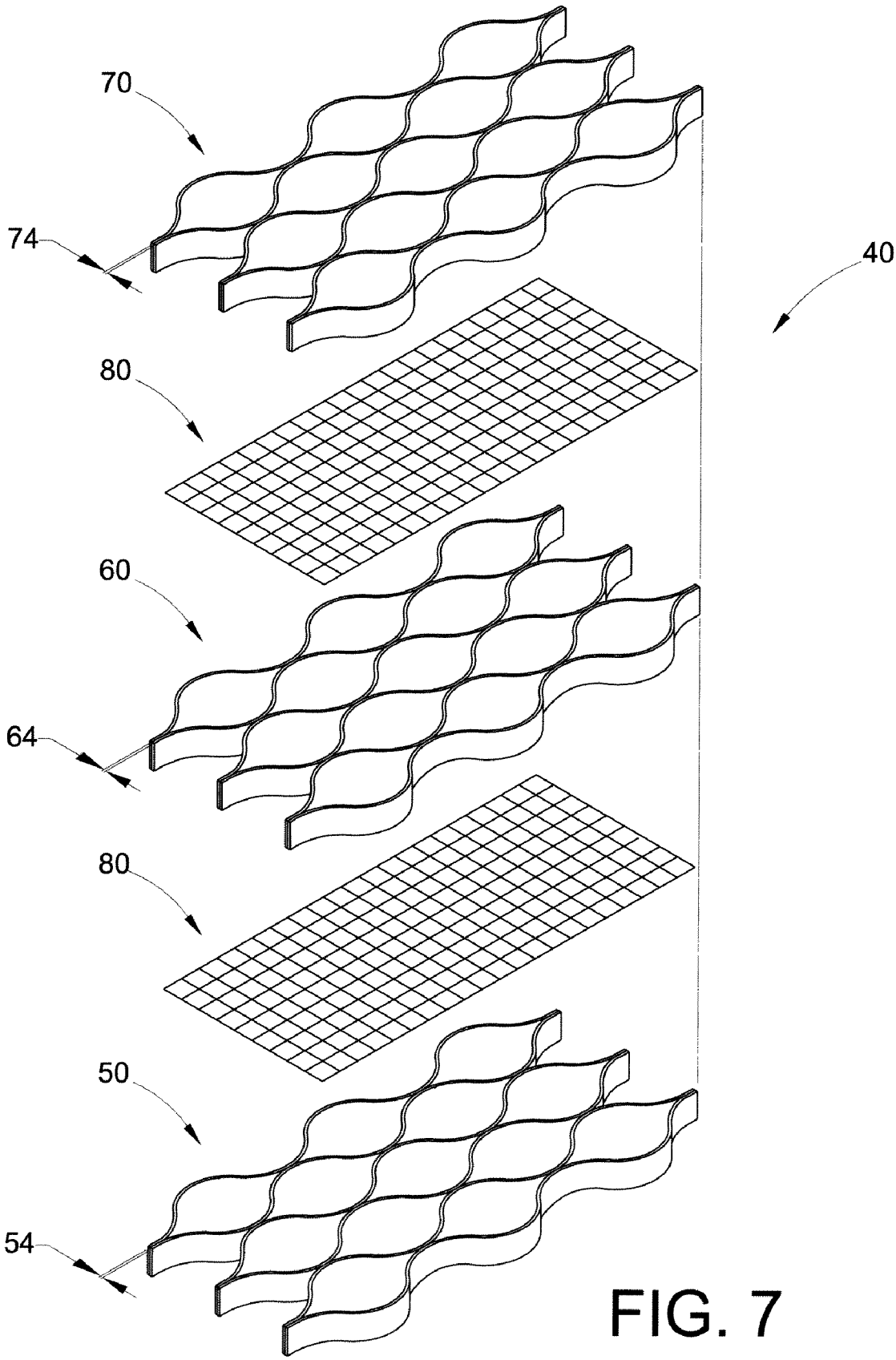
FIG. 7 is a perspective view of a second embodiment of a composite geocell system according to the present disclosure.

If the low quality infill material contains a large amount of fine particles (i.e., particles with an average particle size smaller than 75 μm), the at least one core geocell layer 60 may be surrounded by geotextile layers 80 directly above and below the at least one core geocell layer, as seen in FIG. 7. (The layers are separated for easier illustration.) This will effectively encapsulate the fine particles in the core geocell layer.

Situations may arise where there is a large quantity of low quality material that needs to be disposed of without off-site disposal and its attendant costs. The instant composite system allows that low quality material to be used in the core geocell layer so that off-site disposal is not required. Thus, the height of the composite system may vary according to specific application needs. For example, as seen in FIG. 5, the height 63 of the core geocell layer 60 is greater than both the height 53 of the base geocell layer 50 and the height 73 of the capping geocell layer 70. In specific embodiments, the height of the at least one core geocell layer is at least five times greater than the height of each outer layer. In further embodiments, the height of the at least one core geocell layer may be from about five times to about 100 times greater than the height of each outer layer. In further specific embodiments, the height of the at least one core geocell layer may be from about five times to about 10 times greater than the height of each outer layer. In embodiments having at least two outer geocell layers (a base geocell layer and a capping geocell layer), the height of the at least one core geocell layer is greater than the height of both the base layer and the capping layer.

Figure 8:
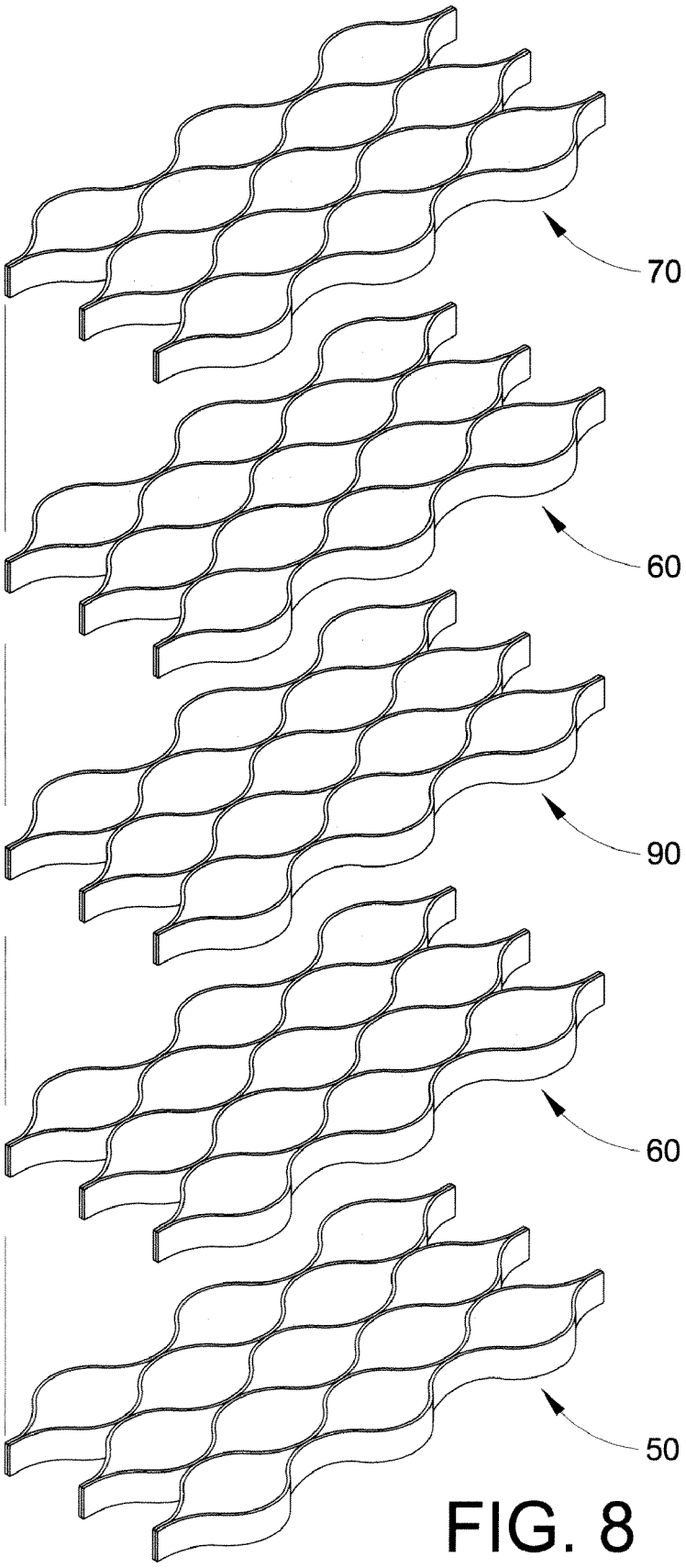
FIG. 8 is a perspective view of a third embodiment of a composite geocell system according to the present disclosure.

In other embodiments, there are more than one core geocell layers. In yet other embodiments, the composite geocell system may further comprise at least one reinforcing geocell layer containing high quality infill material, the at least one reinforcing geocell layer being located between the base layer and the capping layer. In further embodiments, a reinforcing geocell layer is located between two core geocell layers. An exemplary embodiment is shown in FIG. 8, where the reinforcing geocell layer 90 is located between two core geocell layers 60 and these three layers are located between the capping geocell layer 70 and the base geocell layer 50. (The layers are separated for easier illustration.)

The stiffness of the geocell can be adjusted by its composition and wall thickness. In specific embodiments, the wall thickness 64 of the core geocell layer 60 is at least 20% thicker than the wall thickness 54 of the base geocell layer 50 and the wall thickness 74 of the capping geocell layer 70, as depicted in FIG. 7. The geocell may comprise a material selected from the group consisting of engineering thermoplastics, such as polyamide, polyester, and alloys thereof. The alloys may further comprise polyethylene or polypropylene. The engineering thermoplastics may be reinforced with fibers, such as glass fibers, metal fibers, Kevlar™ fibers, polyamide fibers, and polyester fibers. In specific embodiments, the material from which the geocell is constructed may comprise a long glass fiber-reinforced polyester-HDPE alloy. In specific embodiments, the material from which the geocell is constructed may have a tensile elastic modulus at 10% per minute strain rate and 1% deformation of 700 MPa or greater. In other specific embodiments, the material from which the geocell is constructed may have a tensile yield stress at 10% per minute strain rate of 15 MPa or greater. In other specific embodiments, the material from which the geocell is constructed may have a creep deformation after 500 hours at 23° C., under 50% of yield stress, of 10% or less.

In specific embodiments, the material from which the core geocell is made comprises a high density polyethylene—polyethylene terephthalate (HDPE-PET) alloy reinforced by up to 30% w/w talc or glass fibers, and the core geocell layer has a wall thickness from about 2 to about 3 mm; and the base geocell layer and capping geocell layer have a wall thickness of about 1.2 mm.

In other embodiments, the material from which the geocells are made comprises a polyethylene—polyethylene terephthalate (PE-PET) alloy. In further embodiments, the PE-PET alloy is reinforced by long glass roving.

The resulting composite geocell system is stiff enough to spread applied loads over a large area so that the load reaching the natural foundation soil is sufficiently small that deflection or settlement is acceptable. Such a system can carry high loads and serve as a temporary road, paved road, a work platform, or a machine foundation. It can meet all engineering specifications but, because it uses low quality infill material, be more economical than a structure using only high quality infill. The composite geocell system also provides a means of using otherwise undesirable material, reducing disposal costs.

Figure 9:
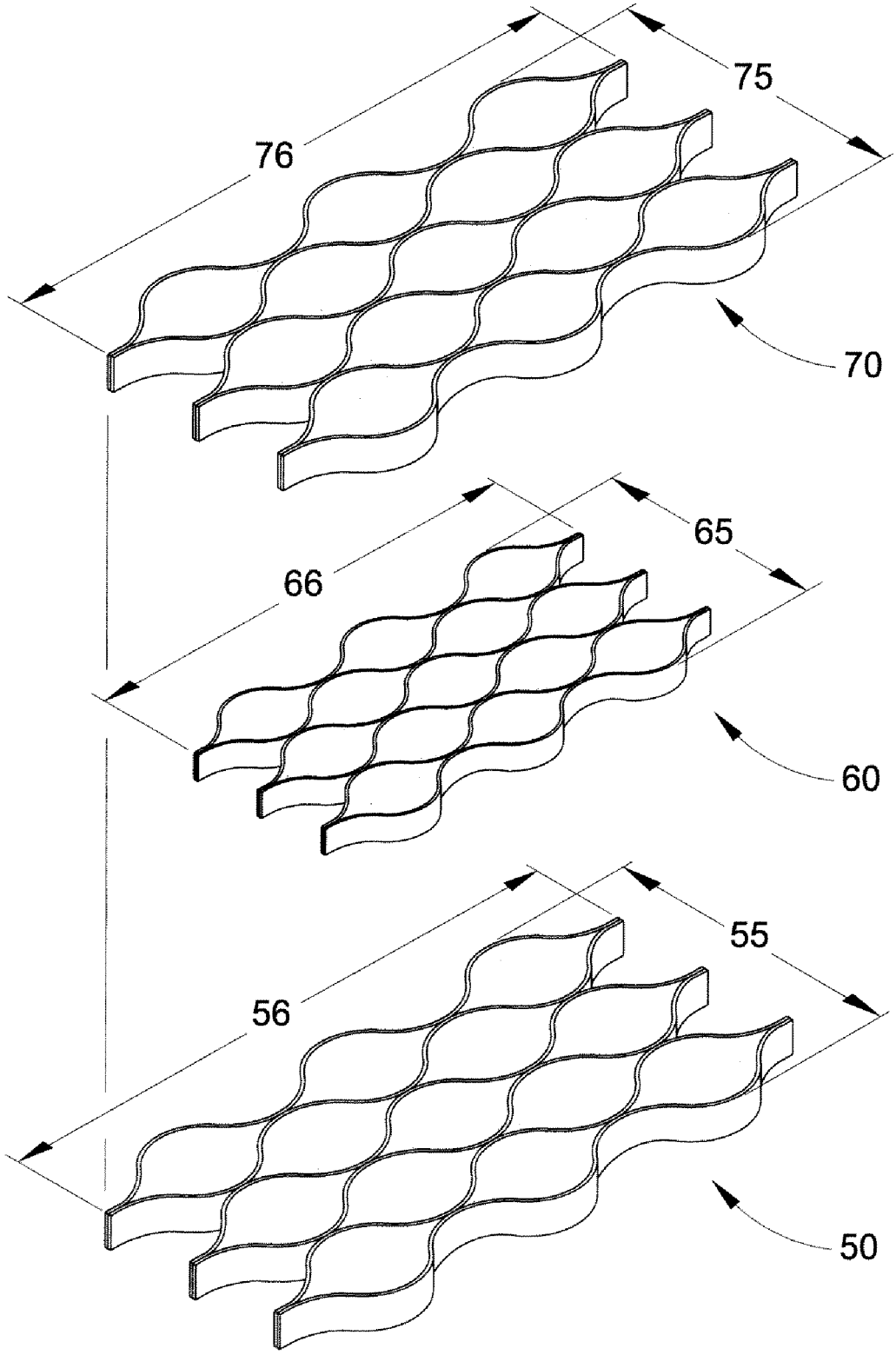
FIG. 9 is a perspective view of a fourth embodiment of a composite geocell system according to the present disclosure.

In some embodiments, the footprint (length times width) of the base layer, core geocell layer, and capping layer may vary. In specific embodiments, the base and capping layers have a larger footprint than the core geocell layer. In particular embodiments, the area of each of the base and capping layers is at least twice the area of the at least one core geocell layer. This embodiment is depicted in FIG. 9, wherein the area of the base layer 50 is the length 55 times the width 56; the area of the core geocell layer 60 is the length 65 times the width 66; and the area of the capping layer 70 is the length 75 times the width 76. In such embodiments, the core layer 60 is generally, but not always, in the middle of the footprint of the base and capping layers.

The composite system may further comprise a water-impermeable membrane located below the base layer. This membrane may reduce the amount of ground water which can enter the core geocell layer, thus reducing the swelling of the low quality infill material. The embodiment shown in FIG. 5 contains a water-impermeable membrane 48.

The core geocell layer allows low quality material to be buried on-site while providing stiffness and moment of inertia stability at relatively high deformations. The outer layer(s) (i.e. the capping and/or base layers) provide stiffness at relatively low deformations.

Obviously, modifications and alterations will occur to others upon reading and understanding the preceding detailed description. It is intended that the exemplary embodiments be construed as including all such modifications and alterations insofar as they come within the scope of the appended claims or the equivalents thereof.

The invention claimed is:

1. A composite system, comprising:

at least one core geocell layer infilled with an infill material; and at least two outer layers, which are a base layer and a capping layer, the base layer and the capping layer having greater tensile strength than the core geocell layer;

the at least one core geocell layer being stacked between the base layer and the capping layer;

wherein the base layer and capping layer are independently selected from the group consisting of a geocell infilled with a high quality material, a fiber reinforced concrete slab, a fiber reinforced polymer sheet, a metal sheet, a fiber reinforced polymeric foam, a fiber reinforced ceramic foam, high quality material reinforced by a geogrid or geotextile, and a geocell filled with concrete or a concrete mixture with particulate material;

and the infill material of the at least one core geocell layer is a low quality material having an internal angle of friction of 25° or less, a permeability of less than $10^{-4}$ cm/sec, and comprising particles, of which 50% by weight or more have an average diameter of less than 75 μm.

2. The composite system of claim 1, wherein the base layer is a geocell infilled with a first high quality material; and the capping layer is a geocell infilled with a second high quality material; wherein the first and second high quality materials independently have an internal angle of friction of 30° or greater, a permeability of $10^{-2}$ cm/sec or greater, and comprise particles, of which 90% by weight or more have an average diameter of 75 μm or greater.

3. The composite system of claim 2, wherein the first high quality material and second high quality material are independently selected from the group consisting of gravel, crushed stone, sand, crushed concrete, and mixtures thereof.

4. The composite system of claim 1, wherein the wall thickness of the core geocell layer is at least 20% thicker than the wall thickness of the base layer and the wall thickness of the capping layer.

5. The composite system of claim 1, wherein the low quality material is selected from the group consisting of silt, low plasticity clay, fly ash, and mixtures thereof.

6. The composite system of claim 1, wherein the low quality material is chemically modified with cement, liquid inorganic binder, or organic binder.

7. The composite system of claim 1, further comprising at least one reinforcing geocell layer infilled with a third high quality material, the at least one reinforcing geocell layer being stacked between the base layer and the capping layer.

8. The composite system of claim 7, having a total of two core geocell layers, wherein the reinforcing geocell layer is located between the two core geocell layers.

9. The composite system of claim 1, wherein a footprint of the base layer and a footprint of the capping layer are both greater than a footprint of the core geocell layer.

10. composite system, comprising:

at least one core geocell layer infilled with an infill material; and at least one outer layer, the outer layer having greater tensile strength than the core qeocell layer;

wherein the at least one outer layer is selected from the group consisting of a qeocell infilled with high quality material; a fiber reinforced polymer sheet; a fiber reinforced concrete slab; a metal sheet; a fiber reinforced polymeric foam; a fiber reinforced ceramic foam; high quality material reinforced by a geoarid or geotextile; and a geocell filled with concrete or a concrete mixture with particulate material; and wherein the core geocell layer is made from a material selected from the group consisting of engineering thermoplastics and alloys thereof with polyethylene or polypropylene.

11. The composite system of claim 10, wherein the material is further reinforced with fibers.

12. The composite system of claim 10, wherein the material comprises a high density polyethylene-polyethylene terephthalate (HDPE-PET) alloy reinforced by up to 30% w/w talc or glass fibers.

13. A composite geocell system, comprising:

a base geocell layer infilled with a first high quality material;

a capping geocell layer infilled with a second high quality material; and at least one core geocell layer infilled with a low quality material;

wherein the at least one core geocell layer is stacked between the base geocell layer and the capping geocell layer;

the low quality material has an internal angle of friction of 25° or less, a permeability of less than $10^{-4}$ cm/sec, and comprises particles, of which 50% by weight or more have an average diameter of less than 75 μm; and the first and second high quality materials independently have an internal angle of friction of 30° or greater, a permeability of $10^{-2}$ cm/sec or greater, and comprise particles, of which 90% by weight or more have an average diameter of 75 μm or greater.

14. The composite geocell system of claim 13, wherein the height of the core geocell layer is greater than the height of the base geocell layer and the height of the capping geocell layer.

15. A composite geocell system, comprising:

a base geocell layer infilled with a first high quality material;

a capping geocell layer infilled with a second high quality material; and at least one core geocell layer infilled with a low quality material;

wherein the at least one core geocell layer is stacked between the base geocell layer and the capping geocell layer;

the low quality material is selected from the group consisting of silt, low plasticity clay, fly ash, and mixtures thereof; and the first and second high quality materials are independently selected from the group consisting of gravel, crushed stone, sand, crushed concrete, and mixtures thereof.

16. The composite system of claim 15, wherein the wall thickness of the core geocell layer is at least 20% thicker than the wall thickness of the base geocell layer and the wall thickness of the capping geocell layer.

* * * * *